US008147625B2

(12) United States Patent
Reiso et al.

(10) Patent No.: US 8,147,625 B2
(45) Date of Patent: Apr. 3, 2012

(54) AL-MG-SI ALLOY SUITED FOR EXTRUSION

(75) Inventors: Oddvin Reiso, Sunndalsøra (NO); Jostein Røyset, Sunndalsøra (NO); Jan Anders Sæter, Sunndalsøra (NO); Ulf Tundal, Sunndalsøra (NO); Gunnar Gjertsen, Avaldsnes (NO)

(73) Assignee: Norsk Hydro ASA, Oslo (NO)

( * ) Notice: Subject to any disclaimer, the term of this patent is extended or adjusted under 35 U.S.C. 154(b) by 468 days.

(21) Appl. No.: 10/576,108

(22) PCT Filed: Oct. 15, 2004

(86) PCT No.: PCT/NO2004/000315

§ 371 (c)(1),
(2), (4) Date: Jul. 17, 2006

(87) PCT Pub. No.: WO2005/038063

PCT Pub. Date: Apr. 28, 2005

(65) Prior Publication Data

US 2007/0039669 A1 Feb. 22, 2007

(30) Foreign Application Priority Data

Oct. 22, 2003 (NO) ..... 20034731

(51) Int. Cl.
*C22C 21/08* (2006.01)

(52) U.S. Cl. ..... 148/440; 420/546

(58) Field of Classification Search ..... 420/546; 148/440

See application file for complete search history.

(56) References Cited

U.S. PATENT DOCUMENTS

| | | | | |
|---|---|---|---|---|
| 3,879,194 | A | 4/1975 | Morris et al. | |
| 6,355,090 | B1 * | 3/2002 | Ohyama et al. | 75/687 |
| 6,440,359 | B1 * | 8/2002 | Parson et al. | 420/544 |

FOREIGN PATENT DOCUMENTS

| | | |
|---|---|---|
| JP | 60204857 | * 10/1985 |
| WO | 95/06759 | 3/1995 |
| WO | 98/42884 | 10/1998 |

OTHER PUBLICATIONS

Abstract of JP60204857.*

* cited by examiner

*Primary Examiner* — Jie Yang
(74) *Attorney, Agent, or Firm* — Wenderoth, Lind & Ponack, L.L.P.

(57) ABSTRACT

Aluminum alloy containing Mg and Si, in particular useful for extrusion purposes containing in wt %:

| | |
|---|---|
| Mg | 0.3-0.5 |
| Si | 0.35-0.6 |
| Mn | 0.02-0.08 |
| Cr | 0.05 |
| Zn | 0.15 |
| Cu | 0.1 |
| Fe | 0.08-0.28 and |

in addition grain refining elements up to 0.1 wt % and incidental impurities up to 0.15 wt %.

The manganese (Mn), within the specified limits, has an additional positive effect on the extrudability of an AlMgSi alloy. In addition to promoting the transformation of the AlFeSi intermetallic phases, AlMnFeSi dispersoid particles are formed during homogenization. These particles are acting as nucleation sites for $Mg_2Si$ particles during cooling after homogenization. In a high quality billet the $Mg_2Si$ particles formed during cooling after homogenization should easily dissolve during the preheating and the extrusion operation before the material reach the die opening.

3 Claims, 8 Drawing Sheets

Dispersoid density in 6060 types of alloys with constant Mg and Si and Fe contents versus the Mn content of the alloys.

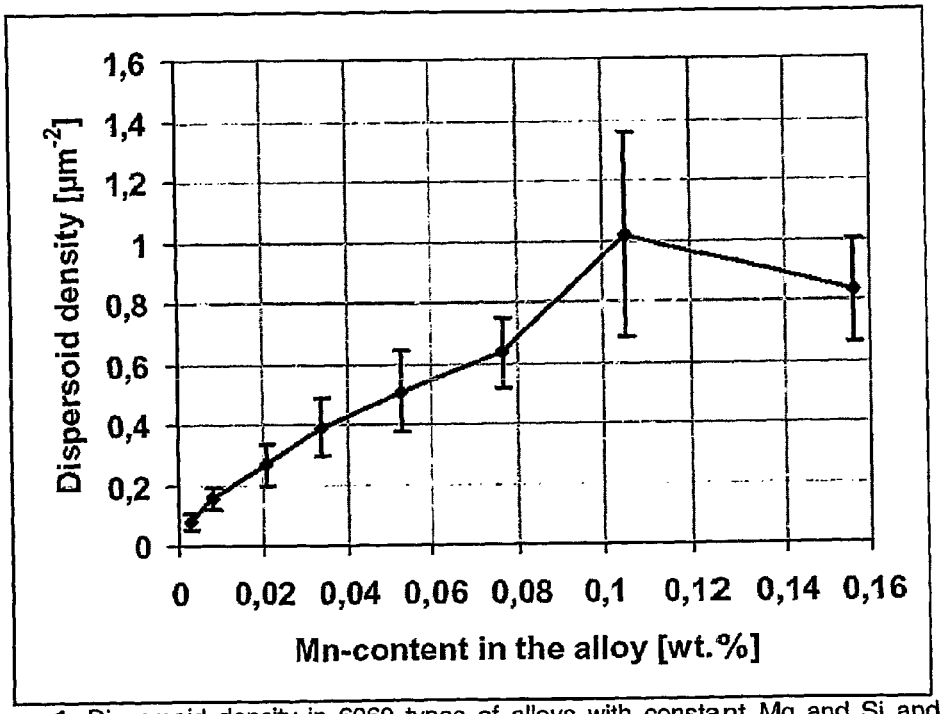
Figure 1: Dispersoid density in 6060 types of alloys with constant Mg and Si and Fe contents versus the Mn content of the alloys.

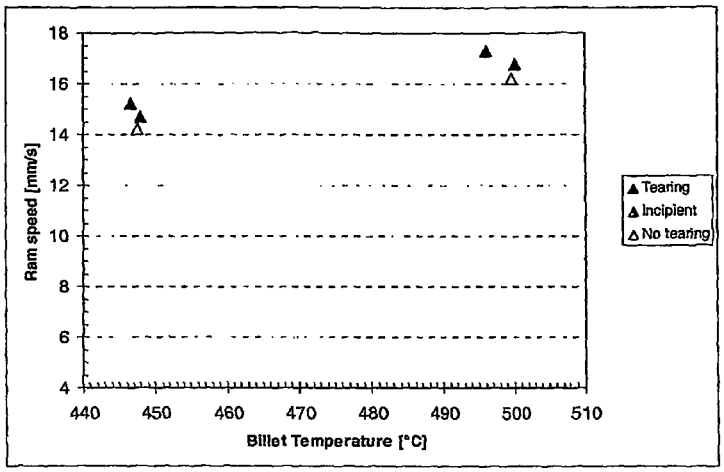
a) Alloy 1: 0.03wt% Mn
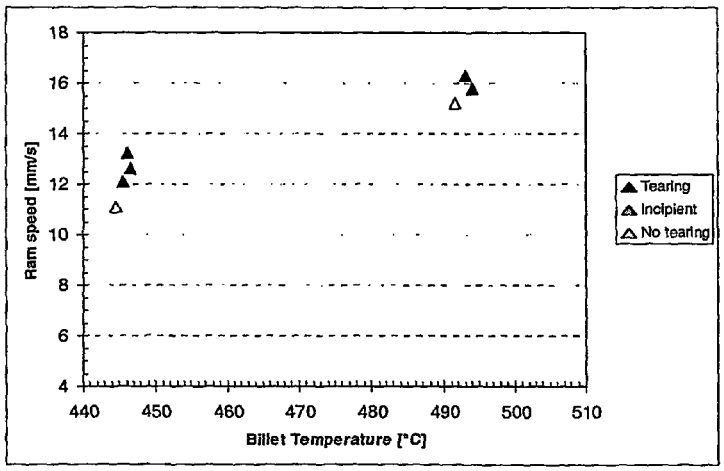
b) Alloy 2: 0.006 wt% Mn
Figure 2: Extrusion ram speed versus billet temperature for two alloys with equal Mg, Si and Fe contents and different Mn contents. Dark triangles represent profiles with tearing and open triangles represent good profiles.

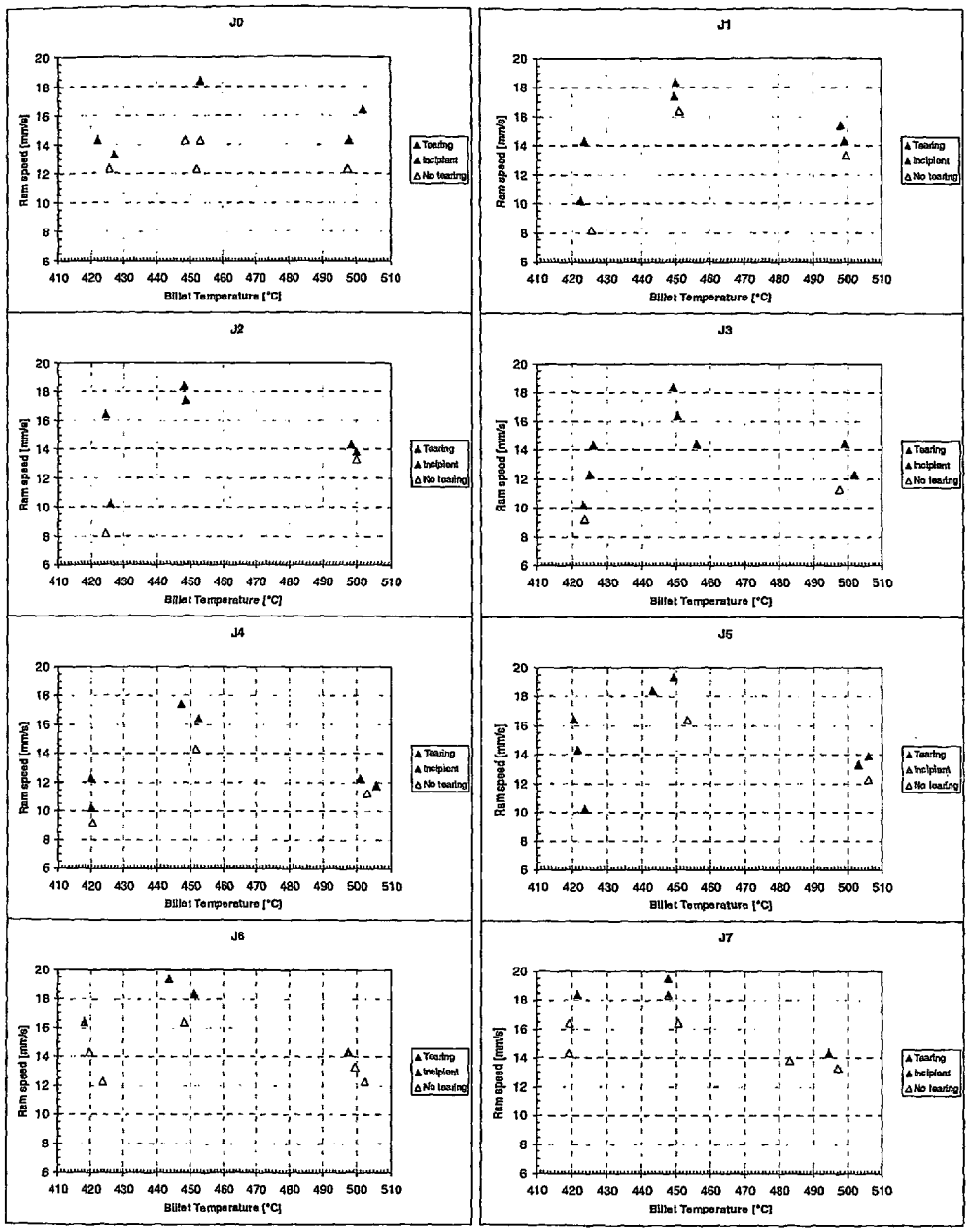
Figure 3: Extrusion ram speed versus billet temperature for eight alloys with equal Mg, Si and Fe contents and different Mn contents. Dark triangles represent profiles with tearing and open triangles represent good profiles.

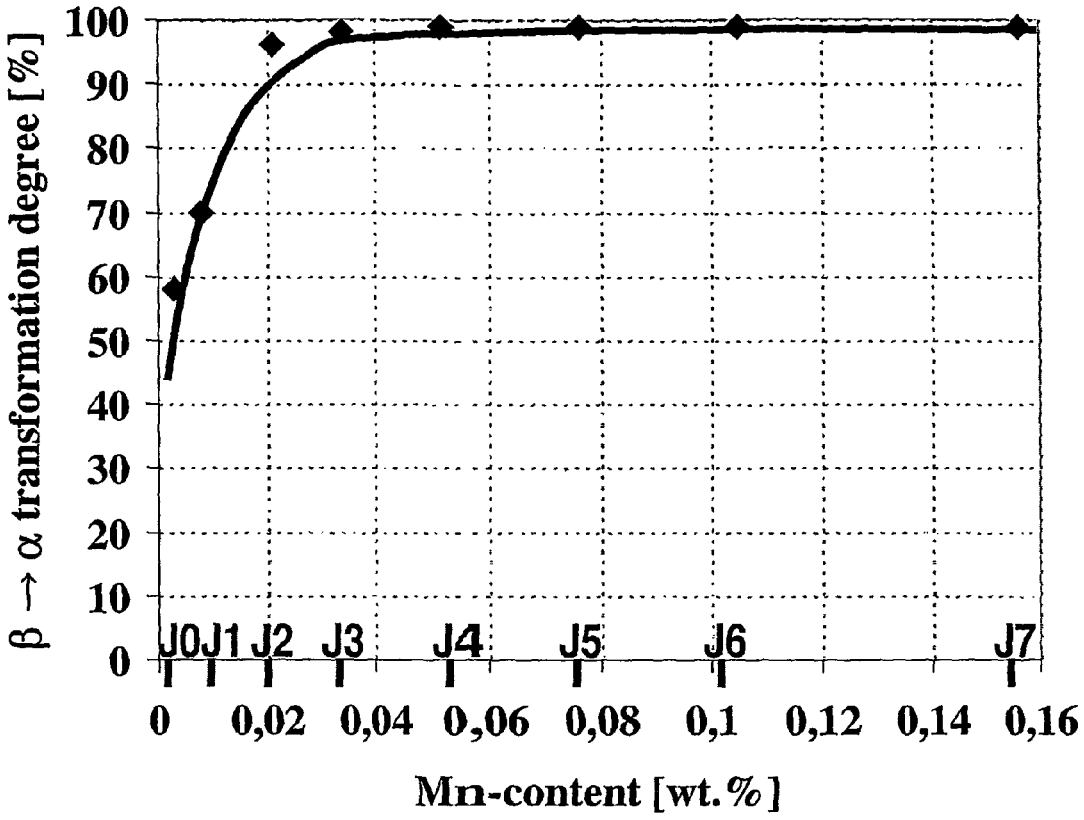
Figure 4: Degree of transformation of β-AlFeSi to α-AlFeSi in alloy variants J0..J7.

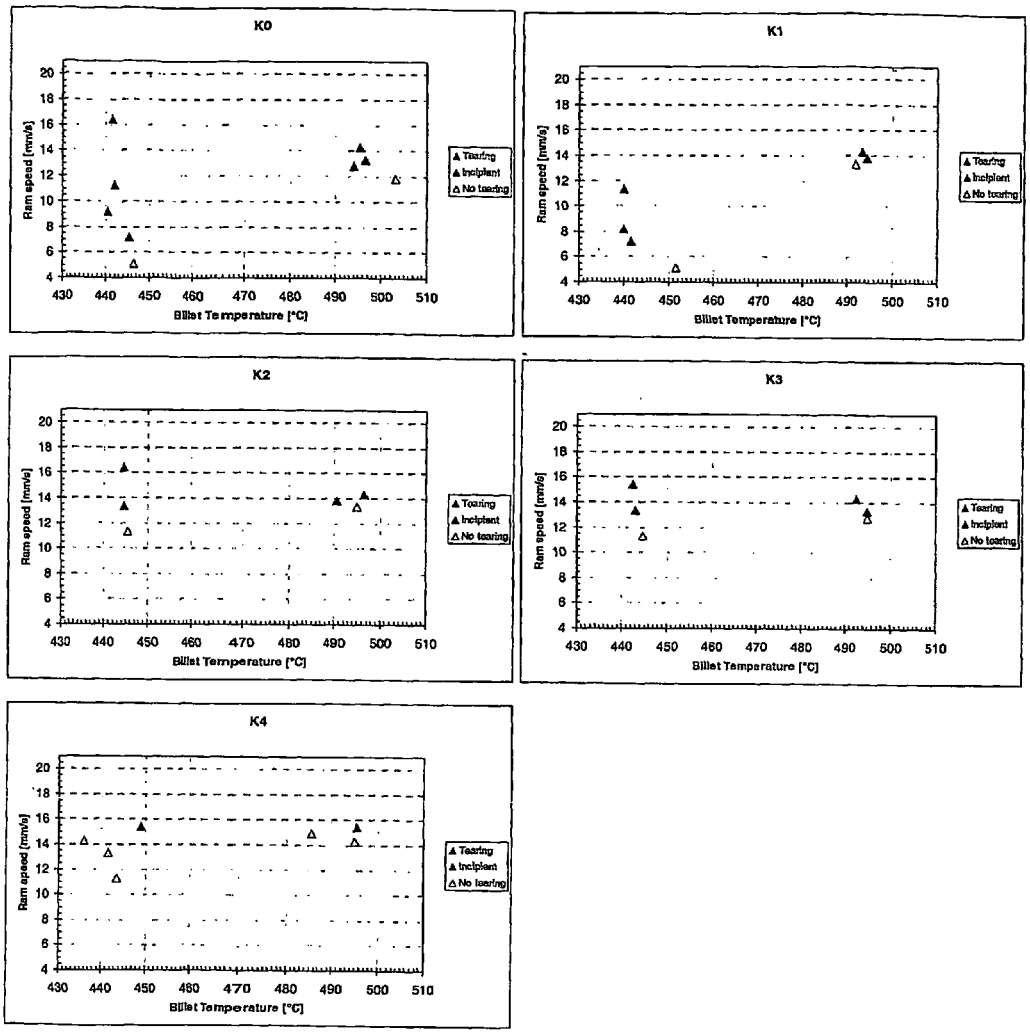
Figure 5: Extrusion ram speed versus billet temperature for five alloys with equal Mg, Si and Fe contents and different Mn contents. Dark triangles represent profiles with tearing and open triangles represent good profiles.

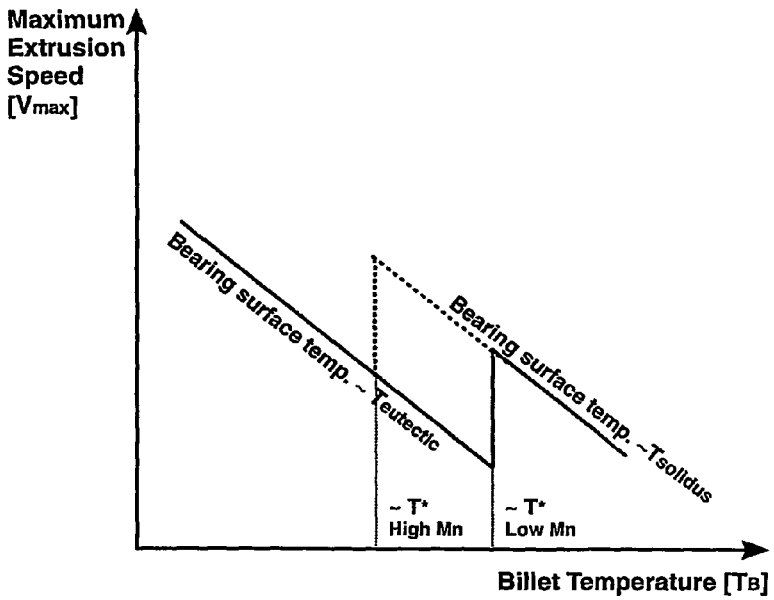
Figure 6. Schematic diagram of max. extrusion speed as a function of billet temperature and tearing mechanism. Billet temperature for the transition of mechanism, T*, is indicated for a low and a high Mn-level

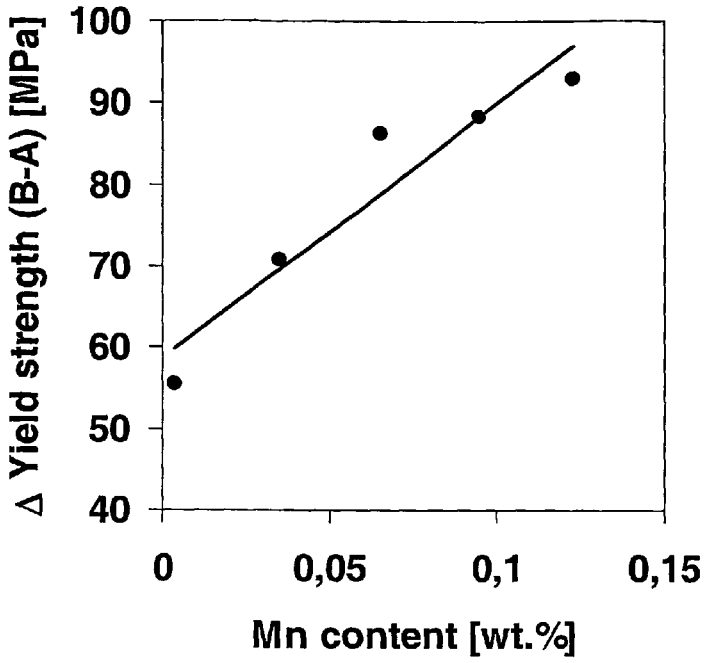
Figure 7. Quench sensitivity of five alloys with equal Mg, Si and Fe contents and different Mn contents in terms of decrease in yield strength. The decrease in yield strength is plotted as a function of Mn content.

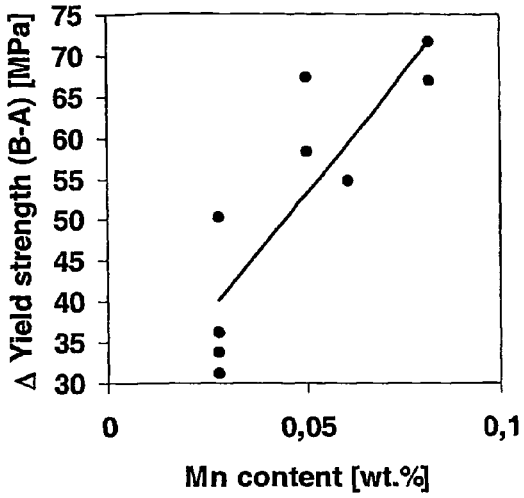
a)
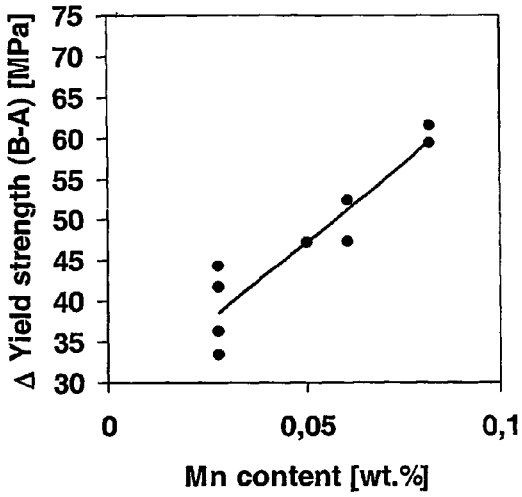
b)
Figure 8. Quench sensitivity of open (a) and hollow (b) profiles of four alloys with equal Mg, Si and Fe contents and different Mn contents in terms of decrease in yield strength. The decrease in yield strength is plotted as a function of Mn content.

AL-MG-SI ALLOY SUITED FOR EXTRUSION

The present invention relates to aluminium alloy containing Mg and Si, and which in particular is useful for extrusion purposes at high speed.

The alloy contains manganese, Mn as an important alloying element.

In what may be regarded as the closest prior art, WO 98/42884 it is stated that Mn has a technical effect when included in AlMgSi alloys at levels above 0.02 wt % preferably at least 0.03 wt %. At Si levels of about 0.50 wt % or greater the stability of the β-AlFeSi is increased during homogenisation, and the transformation of the AlFeSi intermetallic from β to α is retarded. A low transformation degree of the AlFeSi intermetallic phases is claimed to give reduced extrudability and poor surface finish. The mechanism when adding Mn at levels above 0.02 wt % is that the stability of the β-AlFeSi phase is reduced. Mn additions will thus promote transformation of the AlFeSi intermetallic from β to α, reduce the sizes and increase the spherodization of the intermetallics. The following minimum content of Mn as a function of the Si content is proposed:

$$\text{Wt \% manganese} = \text{at least } 0.3 \times \text{wt \% silicon} - 0.12$$

In AlMgSi alloys $Mg_2Si$ particles will melt together with the surrounding matrix if the temperature of the material exceeds the eutectic temperature of $Mg_2Si$+Al (ss). If this happens during extrusion, it will cause tearing in the profile and/or negatively affect the surface quality of the extruded profile. Therefore, it is of outmost importance to avoid large $Mg_2Si$ particles that are present when the material reach the die opening and may give rise to such melting reactions during extrusion.

With the present invention it is found that the Mn has an additional positive effect on the extrudability of an AlMgSi alloy. In addition to promoting the transformation of the AlFeSi intermetallic phases, AlMnFeSi dispersoid particles are formed during homogenisation. These particles are acting as nucleation sites for $Mg_2Si$ particles during cooling after homogenisation. In a high quality billet the $Mg_2Si$ particles formed during cooling after homogenisation should easily dissolve during the preheating and the extrusion operation before the material reach the die opening. With a larger number of dispersoid particles a higher number of $Mg_2Si$ particles are formed, resulting in a reduced size of each particle. Since the rate of dissolution of an $Mg_2Si$ particle is proportional to its size, a high quality billet should contain a certain amount of AlMnFeSi dispersoid particles, which promote the formation of a relatively large number of small $Mg_2Si$ particles that dissolve easily during the preheating and extrusion operation.

The alloy according to the invention is characterized in that it contains in wt %:

| | |
|---|---|
| Mg | 0.3-0.5 |
| Si | 0.35-0.6 |
| Mn | 0.02-0.08 |
| Cr | 0.05 |
| Zn | 0.15 |
| Cu | 0.1 |
| Fe | 0.08-0.28 and |

in addition grain refining elements up to 0.1 wt % and incidental impurities up to 0.15, as defined in the attached claim 1.

Dependent claims 2-4 define preferred embodiments of the invention.

The invention will be further described in the following by way of examples and with reference to the drawings in which:

FIG. 1 shows, based on tests, the dispersoid density in 6060 types of alloys with constant Mg and Si and Fe contents versus the Mn content of the alloys, FIG. 2 shows the extrusion ram speed versus billet temperature for the two alloys with equal Mg, Si and Fe contents and different Mn contents where dark triangles represent profiles with tearing and open triangles represent good profiles (without tearing).

FIG. 3 shows the extrusion ram speed versus billet temperature for eight alloys with equal Mg, Si and Fe contents and different Mn contents where dark triangles represent profiles with tearing and open triangles represent good profiles.

FIG. 4 shows the degree of transformation of β-AlFeSi to α-AlFeSi in alloy variants J0-J7 related to FIG. 3.

FIG. 5 shows the extrusion ram speed versus billet temperature for five alloys with equal Mg, Si and Fe contents and different Mn contents where dark triangles represent profiles with tearing and open triangles represent good profiles.

FIG. 6 shows a schematic diagram of max. extrusion speed as a function of billet temperature and tearing mechanism. Billet temperature for the transition of mechanism, T*, is indicated for a low and a high Mn-level.

FIG. 7 shows the quench sensitivity in terms of decrease in yield strength for five alloys with equal Mg, Si and Fe contents and different Mn contents, as a function of the Mn content of the alloys.

FIGS. 8*a*) and *b*) shows the quench sensitivity in terms of decrease in yield strength for open profiles and hollow profiles, respectively, of four alloys with equal Mg, Si and Fe contents and different Mn contents, as a function of the Mn content of the alloys.

The number of dispersoid particles that are formed depends on the Mn content in the alloy. In FIG. 1 the number density of dispersoid particles in as-homogenised 6060 type of alloys with constant Mg and Si and Fe contents are plotted against the Mn content of the alloys. The densities are not true average numbers densities, but represent number densities in areas with the highest number of dispersoid particles. However, the numbers should represent relative differences between the investigated alloys.

The effect of the Mn content and thus the number of dispersoid particles on the maximum extrusion speed is further, based on tests, demonstrated in FIG. 2. Two alloys of type 6060, the measured compositions of which are given in Table 1 below, essentially with constant Mg, Si and Fe contents and two different Mn contents are investigated. The extrusion speed is plotted against the billet temperature. Dark triangles represent profiles with tearing and open triangles represent good profiles. In FIG. 2*a*) where the Mn content is 0.03 wt % the maximum extrusion speed at temperatures around 445° C. is significantly higher than in FIG. 2*b*) where the Mn content is 0.006 wt %.

TABLE 1

Measured composition of alloy 1 and alloy 2

| Alloy | % Si | % Fe | % Cu | % Mn | % Mg | % Cr | % Zn | % Ti |
|---|---|---|---|---|---|---|---|---|
| 1 | 0.41 | 0.18 | 0.002 | 0.028 | 0.46 | 0.004 | 0.010 | 0.009 |
| 2 | 0.44 | 0.19 | 0.002 | 0.006 | 0.46 | 0.002 | 0.014 | 0.014 |

Both alloys were cooled at a rate of 400° C./hour after homogenisation. The higher number of dispersoid particles in alloy 1 with the highest Mn content, results in smaller $Mg_2Si$ particles than in alloy 2. At the lowest preheating temperature, approximately 445° C., the $Mg_2Si$ particles in alloy 2 do not dissolve and tearing of the profile is observed at ram speeds of 12 mm/sec or higher. In alloy 1 with smaller particle sizes, the $Mg_2Si$ particles at least partially dissolve and tearing of the profile does not occur until the ram speed reaches 14.5 mm/sec. With an even higher Mn content, which would have resulted in smaller $Mg_2Si$ particles, the maximum extrusion speed would probably have been more than 18 mm/sec.

At the highest preheating temperature the alloy variant with the highest Mn content show a slightly better extrudability than the alloy variant with low Mn. The degrees of transformation of β-AlFeSi to α-AlFeSi are 94% for alloy 1 with 0.03 wt % Mn and 54% for alloy 2 with 0.006 wt % Mn.

The results of a further test is shown in FIG. 3. In this case alloys of a 6060 type, the measured compositions of which are given in table 2 below, with essentially constant Mg, Si and Fe contents and variable Mn contents were cooled from the homogenisation temperature at a rate of 400° C./hour.

TABLE 2

Measured composition of the alloys J0 through J7

| Alloy | % Si | % Fe | % Cu | % Mn | % Mg | % Cr | % Zn | % Ti |
|---|---|---|---|---|---|---|---|---|
| J0 | 0.46 | 0.23 | 0.002 | 0.003 | 0.38 | 0.002 | 0.007 | 0.023 |
| J1 | 0.47 | 0.23 | 0.002 | 0.008 | 0.38 | 0.001 | 0.007 | 0.014 |
| J2 | 0.46 | 0.21 | 0.007 | 0.021 | 0.37 | 0.001 | 0.007 | 0.015 |
| J3 | 0.47 | 0.22 | 0.002 | 0.034 | 0.40 | 0.001 | 0.006 | 0.013 |
| J4 | 0.47 | 0.23 | 0.002 | 0.053 | 0.40 | 0.001 | 0.006 | 0.016 |
| J5 | 0.45 | 0.22 | 0.007 | 0.076 | 0.36 | 0.001 | 0.005 | 0.018 |
| J6 | 0.45 | 0.22 | 0.008 | 0.105 | 0.36 | 0.001 | 0.005 | 0.019 |
| J7 | 0.45 | 0.22 | 0.008 | 0.156 | 0.36 | 0.001 | 0.004 | 0.015 |

At the lowest preheating temperature the two variants, J6 and J7, with the highest Mn contents show a better extrudability than the other variants with lower Mn contents. Again, the explanation is the same: the higher number of dispersoid particles in these two variants results in smaller $Mg_2Si$ particles that dissolves or partially dissolves, resulting in higher extrusion speeds before tearing of the profile is observed.

At the two highest preheating temperatures there are only small differences in maximum extrusion speeds between the alloys. The degrees of transformation of β-AlFeSi to α-AlFeSi are shown for alloy variants J0 to J7 in FIG. 4. Even though the degree of transformation is lower than the recommended 80% (in the previously mentioned WO 98/42884 reference) for the variants J0 and J1, they actually show the highest maximum extrusion speed of all the alloy variants at the two highest preheating temperatures.

In a third example, also with alloys within the 6060 window, and with essentially constant levels of Mg, Si and Fe and varying levels of Mn as shown in Table 3, the beneficial effect of Mn is further demonstrated. These alloys were cooled at a rate of 240° C./h after homogenisation. The results of the extrudability tests are shown in FIG. 5.

TABLE 3

Measured composition of the alloys K0 through K4

| Alloy | % Si | % Fe | % Cu | % Mn | % Mg | % Cr | % Zn | % Ti |
|---|---|---|---|---|---|---|---|---|
| K0 | 0.36 | 0.21 | 0.01 | 0.004 | 0.47 | 0.002 | 0.004 | 0.012 |
| K1 | 0.36 | 0.21 | 0.01 | 0.035 | 0.47 | 0.002 | 0.004 | 0.011 |
| K2 | 0.37 | 0.20 | 0.005 | 0.065 | 0.45 | 0.002 | 0.004 | 0.023 |
| K3 | 0.37 | 0.20 | 0.005 | 0.095 | 0.45 | 0.002 | 0.005 | 0.014 |
| K4 | 0.36 | 0.23 | 0.004 | 0.123 | 0.45 | 0.001 | 0.007 | 0.011 |

For the low billet preheating temperature one finds that the maximum extrusion speed before tearing is greatly enhanced when the Mn level exceeds 0.03 wt. %, whereas for the high billet temperature the maximum extrusion speed is little, if anything at all, influenced by the Mn level of the alloys.

In all the three examples shown above, there are only small differences in maximum extrusion speed between alloys with high and low Mn contents at high preheating temperatures. The reason for this is that the $Mg_2Si$ particles have dissolved for all alloys at these high billet temperatures, and not only in the alloys with the smallest particle sizes (i.e. highest Mn content). At higher billet temperatures the mechanism that is causing tearing is melting of the Al (ss) together with AlFeSi intermetallic phases (this temperature is very close to the solidus temperature of the alloy). At lower billet temperatures melting of $Mg_2Si$ particles together with Al (ss) cause tearing, which occurs at a lower billet exit temperature and therefore at a lower speed. It is well known that the maximum extrusion speed increases with lower billet temperatures as long as the mechanism that causes tearing does not change. Adding Mn leads to a higher number density but smaller mean size of the $Mg_2Si$ particles, whereby it is possible to maintain the tearing mechanism which is melting of the Al (ss) together with AlFeSi intermetallic phases down to lower preheating temperatures. Because melting of $Mg_2Si$ particles is avoided at low preheating temperatures in alloys with small $Mg_2Si$ particles, it is possible to take advantage of the low billet temperature and thus increase the extrusion speed.

FIG. 6 shows a schematic diagram where the maximum extrusion speed is limited by the melting temperature of Al (ss)+AlFeSi intermetallic particles (~solidus temperature) at high billet temperatures, and by melting of $Mg_2Si$+Al (ss) (eutectic temperature) at low billet temperatures. The temperature where the transition between the two mechanisms occurs, T*, is depending on the sizes of the $Mg_2Si$ particles in the material. For small $Mg_2Si$ particle sizes the transition temperature occurs at low temperatures and is shifted towards higher billet temperatures with increasing $Mg_2Si$ particle sizes.

The $Mg_2Si$ particle sizes depend on factors like Mg and Si content of the alloy, cooling rate after homogenisation and the nucleation conditions for $Mg_2Si$ particles. Mg and Si are added to give the necessary strength of the material in the final ageing treatment of the extruded profiles and are therefore difficult to change. The cooling rate after homogenisation is more or less given by the cooling equipment and the diameter of the billets, and an increase of the cooling rate would require major investments in the cast house. As demonstrated above it is possible to alter the nucleation conditions for $Mg_2Si$ particles by adding small amounts of Mn to the alloy.

In order to obtain the effects described above, Mn contents of at least 0.02 wt. %, preferably 0.03 wt. % or above would be necessary. The exact amount of Mn will depend on the Mg and Si contents in the alloy, and the cooling rate after homogenisation. At too high Mn contents the AlMgSi alloys become quench sensitive. Since the AlMnFeSi dispersoid particles act as nucleation sites for $Mg_2Si$ particles, a slow cooling rate after extrusion will allow a large amount of $Mg_2Si$ particles to grow during cooling after extrusion. The large $Mg_2Si$ particles will not contribute to increasing the strength of the material, but rather drain the material for Mg and Si that should have been used in the age hardening process for nucleating a large amount of Mg—Si hardening precipitates. As a result, too high Mn contents in the alloy will give lower strength in the extruded profiles.

The effect of the Mn level of the quench sensitivity problem is illustrated by the following example: Extruded profiles of the alloys of Table 3 (K0 through K4) were solution heat treated at 550° C. and subjected to two different cooling procedures prior to age hardening.

Route A—For formation of non-hardening $Mg_2Si$ particles in a reproducible manner Quench to 250° C. and keeping at 250° C. for 30 s Subsequent up-quench to 375° C. and keeping at 375° C. for 2 min Subsequent water-quenched to room temperature, and keeping at room temperature for 4 h Route B—For obtaining the maximum age hardening potential of the alloys Water-quenched to room temperature, and keeping at room temperature for 4 h After these cooling procedures, the profile samples were age hardened at 185° C. for 5 h. By subtracting the age hardening response of samples subjected to Route A from the corresponding age hardening response of samples subjected to Route B one has a direct measure of the quench sensitivity of the alloy in terms of lost age hardening potential. FIG. 7 shows the lost hardening potential in terms of decrease in yield strength as a function of Mn content in the alloys K0 through K4. There is a steady increase in the quench sensitivity with increasing Mn content of the alloys.

This experiment was repeated for another series of alloys with essentially equal Mg, Si and Fe contents and different Mn contents as given in Table 4. Both open and hollow profiles were extruded from these alloys, and samples from the extruded profiles were subjected to the same heat treatment procedures as described above. FIGS. 8*a*) and *b*) show the lost hardening potential in terms of decrease in yield strength as a function of Mn content in the alloys L1 through L4 for the open profile and the hollow profile, respectively. Once again one finds a steady increase in the quench sensitivity with increasing Mn content of the alloys.

TABLE 4

Measured composition of the alloys L1 through L4

| Alloy | Si | Fe | Cu | Mn | Mg | Cr | Zn | Ti |
|---|---|---|---|---|---|---|---|---|
| L1 | 0.43 | 0.20 | 0.002 | 0.028 | 0.37 | 0 | 0 | 0.010 |
| L2 | 0.44 | 0.24 | 0.002 | 0.050 | 0.37 | 0 | 0 | 0.012 |
| L3 | 0.43 | 0.23 | 0.002 | 0.061 | 0.36 | 0 | 0 | 0.010 |
| L4 | 0.43 | 0.24 | 0.002 | 0.082 | 0.36 | 0 | 0 | 0.013 |

In view of these observations, it is appropriate to impose an upper limit on the Mn level of the alloys so that one achieves the desired increase in extrudability with a minimum increase in the quench sensitivity. For the three examples of extrudability shown above, the desired effect of Mn has been achieved for Mn levels in the approximate range 0.02 wt. %-0.08 wt. %. Therefore it is reasonable to set 0.08 wt. % as an upper limit. It is thought that one in most cases may achieve the desired effect of Mn within a lower upper limit, for instance 0.06 wt. %.

Another aspect of the quench sensitivity problem, i.e. excessive formation of (Mg,Si) particles on the AlMnFeSi dispersoid particles during cooling after extrusion, is the effect of the (Mg, Si) particle distribution on the surface appearance on anodised profiles. In order to maintain a consistent surface appearance on anodised profiles it is necessary to impose an upper limit on the Mn content of the alloy.

The three examples on extrudability shown above have demonstrated that higher numbers of AlMnFeSi dispersoid particles have a positive effect on the maximum extrusion speed of AlMgSi alloys. Since the positive effect of Mn on extrudability is a result of the effect of the dispersoid particles on the nucleation and growth of $Mg_2Si$ particles, Mn has a positive effect on all AlMgSi alloys and not only on alloys with Si contents above approximately 0.50 wt % (ref. WO 98/42884). In the three examples the alloys are of type AA6060, but the positive effect is to be expected also for alloys within AA6063, AA6005 as well as for alloys with lower Mg contents than AA6060.

The invention claimed is:

1. Aluminium alloy useful for extrusion purposes, which contains in wt %:

| | |
|---|---|
| Mg | 0.36-0.5 |
| Si | 0.35-0.6 |
| Mn | 0.03-0.06 |
| Cr | maximum 0.05 |
| Zn | maximum 0.15 |
| Cu | maximum 0.1 |
| Fe | 0.08-0.28 and |

in addition grain refining elements up to 0.1 wt % and incidental impurities up to 0.15 wt %, wherein the alloy includes AlMnFeSi dispersoid particles which are formed during homogenisation and which act as nucleation sites for $Mg_2Si$ particles during cooling after homogenisation.

2. Alloy according to claim 1, wherein the content of Fe is between 0.18-0.25 wt %.

3. Alloy according to claim 1, wherein the temperature prior to extrusion is between 430-510° C.

* * * * *

US008147625C1

(12) INTER PARTES REEXAMINATION CERTIFICATE (1271st)

United States Patent

Reiso et al.

(10) Number: US 8,147,625 C1

(45) Certificate Issued: May 20, 2016

(54) AL-MG-SI ALLOY SUITED FOR EXTRUSION

(75) Inventors: Oddvin Reiso, Sunndalsøra (NO); Jostein Røyset, Sunndalsøra (NO); Jan Anders Sæter, Sunndalsøra (NO); Ulf Tundal, Sunndalsøra (NO); Gunnar Gjertsen, Avaldsnes (NO)

(73) Assignee: NORSK HYDRO ASA, Oslo (NO)

Reexamination Request:
No. 95/002,225, Sep. 13, 2012

Reexamination Certificate for:

| | |
|---|---|
| Patent No.: | **8,147,625** |
| Issued: | **Apr. 3, 2012** |
| Appl. No.: | **10/576,108** |
| PCT Filed: | **Oct. 15, 2004** |
| PCT No.: | **PCT/NO2004/000315** |
| § 371 (c)(1), (2), (4) Date: | **Jul. 17, 2006** |
| PCT Pub. No.: | **WO2005/038063** |
| PCT Pub. Date: | **Apr. 28, 2005** |

(30) Foreign Application Priority Data

Oct. 22, 2003 (NO) ..... 20034731

(51) Int. Cl.

| | |
|---|---|
| ***C22C 21/08*** | (2006.01) |
| ***C22C 21/02*** | (2006.01) |
| ***C22F 1/05*** | (2006.01) |

(52) U.S. Cl.

CPC ..... *C22C 21/02* (2013.01); *C22C 21/08* (2013.01); *C22F 1/05* (2013.01)

(58) Field of Classification Search

None

See application file for complete search history.

(56) References Cited

To view the complete listing of prior art documents cited during the proceeding for Reexamination Control Number 95/002,225, please refer to the USPTO's public Patent Application Information Retrieval (PAIR) system under the Display References tab.

*Primary Examiner* — Sean E Vincent

(57) ABSTRACT

Aluminum alloy containing Mg and Si, in particular useful for extrusion purposes containing in wt %:

| | |
|---|---|
| Mg | 0.3-0.5 |
| Si | 0.35-0.6 |
| Mn | 0.02-0.08 |
| Cr | 0.05 |
| Zn | 0.15 |
| Cu | 0.1 |
| Fe | 0.08-0.28 and |

in addition grain refining elements up to 0.1 wt % and incidental impurities up to 0.15 wt %.

The manganese (Mn), within the specified limits, has an additional positive effect on the extrudability of an AlMgSi alloy. In addition to promoting the transformation of the AlFeSi intermetallic phases, AlMnFeSi dispersoid particles are formed during homogenization. These particles are acting as nucleation sites for $Mg_2Si$ particles during cooling after homogenization. In a high quality billet the $Mg_2Si$ particles formed during cooling after homogenization should easily dissolve during the preheating and the extrusion operation before the material reach the die opening.

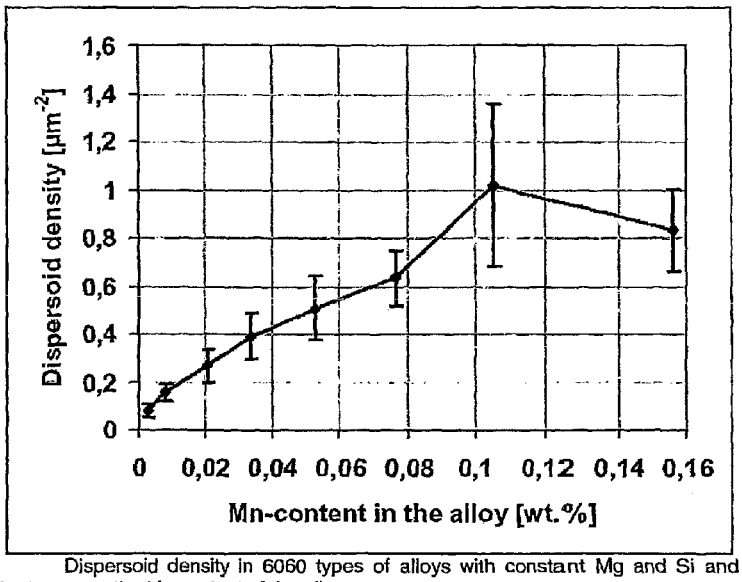

Dispersoid density in 6060 types of alloys with constant Mg and Si and Fe contents versus the Mn content of the alloys.

INTER PARTES REEXAMINATION CERTIFICATE

THE PATENT IS HEREBY AMENDED AS INDICATED BELOW.

AS A RESULT OF REEXAMINATION, IT HAS BEEN DETERMINED THAT:

Claims 1-3 are cancelled.

* * * * *